US008677556B2

(12) United States Patent
Seo

(10) Patent No.: US 8,677,556 B2
(45) Date of Patent: Mar. 25, 2014

(54) UPRIGHT TYPE VACUUM CLEANER

(75) Inventor: Jinwook Seo, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 391 days.

(21) Appl. No.: 13/236,789

(22) Filed: Sep. 20, 2011

(65) Prior Publication Data

US 2012/0180256 A1 Jul. 19, 2012

(30) Foreign Application Priority Data

Jan. 18, 2011 (KR) ..... 10-2011-0004880

(51) Int. Cl.
*A47L 5/28* (2006.01)
*A47L 9/02* (2006.01)

(52) U.S. Cl.
USPC ..... 15/351; 15/411

(58) Field of Classification Search
USPC ..... 15/327.2, 327.4, 350, 351, 410, 411, 15/415.1
See application file for complete search history.

(56) References Cited

U.S. PATENT DOCUMENTS 5,323,510 A * 6/1994 Redding et al. ..... 15/411
5,606,770 A * 3/1997 Sovis et al. ..... 15/350
7,607,196 B2 * 10/2009 Li ..... 15/350
7,805,804 B2 * 10/2010 Loebig ..... 15/351
7,950,102 B2 * 5/2011 Lee et al. ..... 15/327.4
2009/0044368 A1 * 2/2009 Li ..... 15/300.1
2012/0233806 A1 * 9/2012 Streciwilk ..... 15/347

FOREIGN PATENT DOCUMENTS

KR 10-2008-0089435 A 10/2008
KR 10-2009-0074582 A 7/2009

* cited by examiner

*Primary Examiner* — Dung Van Nguyen
(74) *Attorney, Agent, or Firm* — Birch, Stewart, Kolasch & Birch, LLP

(57) ABSTRACT

An upright type vacuum cleaner includes a main body; a suction nozzle provided below the main body; a rotation guide member provided between the main body and the suction nozzle; and a supporting assembly connected with the rotation guide member, to support load of the main body and to guide the movement of the main body with respect to the surface which will be cleaned, wherein the supporting assembly includes a first supporting shaft connected with the rotation guide member, to receive the load of the main body; a second supporting shaft connected with an end of the first supporting shaft to transfer the load of the main body to the first supporting shaft; and wheels rotatably provided at both ends of the second supporting shaft to distribute the load of the main body transferred to the second supporting shaft to the surface which will be cleaned.

20 Claims, 8 Drawing Sheets

UPRIGHT TYPE VACUUM CLEANER

CROSS-REFERENCE TO RELATED APPLICATION

This application claims priority under 35 U.S.C. §119(a) from Korean Application No. 10-2011-0004880 filed Jan. 18, 2011, the subject matter of which is incorporated herein by reference.

BACKGROUND

1. Field

Embodiments may relate to an upright type vacuum cleaner, more particularly, to an upright type vacuum cleaner which is able to distribute load of a main body to enhance a steering ability of the main body.

2. Background

Generally, a vacuum cleaner is an electric appliance that filters dust, dirt and foreign matters scattered on a surface to clean together with air in a main body provided therein, after sucking them by using a suction motor mounted in the main body.

The vacuum cleaner may be classified into an upright type having a suction nozzle integrally formed with the main body as suction inlet and a canister type having a suction nozzle in communication with the main body via a connection pipe.

The upright type vacuum cleaner out of the two types of vacuum cleaners may include a vacuum cleaner main body, a suction nozzle and a handle. A suction motor that generates a suction force may be arranged in the main body. The suction nozzle may suck into the main body dust and foreign matters scattered on a surface which will be cleaned by using the suction force generated in the suction motor. The handle may be provided in an upper area of the vacuum cleaner main body to allow a user to grasp.

In other words, once an electric power is applied to the main body, the suction motor may be driven and the suction force may be generated. The suction force enables the suction nozzle to suck therein the air containing dust and foreign matters scattered on the surface which will be cleaned.

The air containing the dust and foreign matters may be drawn into the main body. The dust and foreign matters may be separated within a dust collection box provided in the main body by cyclone theory.

After that, the separated dust and foreign matters may be collected in the dust collection box and the air having the dust and foreign matters separated there from may be exhausted outside the main body via an air outlet.

However, the main body of such the upright type vacuum cleaner may be seated beyond the suction nozzle. Because of that, all of the pressure generated by the load of the main body having the dust collection box therein may be applied to the suction nozzle. During the cleaning process, a steering ability of the upright type vacuum cleaner happens to deteriorate disadvantageously.

Such a disadvantage may bring up a necessity of a new supporting structure of the main body that is able to distribute the load pressure of the main body and to enhance the steering ability of the upright type vacuum cleaner.

SUMMARY

Accordingly, the embodiments may be directed to an upright type vacuum cleaner. To solve the problems, an object of the embodiments may be to provide an upright type vacuum cleaner which can distribute load of a main body provided therein, with an enhanced steering ability, by providing a supporting assembly including a plurality of supporting shafts to support the main body.

To achieve these objects and other advantages and in accordance with the purpose of the embodiments, as embodied and broadly described herein, an upright type vacuum cleaner includes a main body; a suction nozzle provided below the main body; a rotation guide member provided between the main body and the suction nozzle, to guide rotational movement of the main body to change an arrangement angle of the main body with respect to a surface which will be cleaned; and a supporting assembly connected with the rotation guide member, to support load of the main body and to guide the movement of the main body with respect to the surface which will be cleaned, wherein the supporting assembly includes a first supporting shaft connected with the rotation guide member, to receive the load of the main body; a second supporting shaft connected with an end of the first supporting shaft to transfer the load of the main body to the first supporting shaft; and wheels rotatably provided at both ends of the second supporting shaft to distribute the load of the main body transferred to the second supporting shaft to the surface which will be cleaned.

According to the embodiment, the supporting assembly including the plurality of the supporting shafts arranged perpendicular to each other. Because of that, the load of the main body may be distributed and the supporting power with respect to the main body may be increased. Also, the user's physical fatigue caused by the load of the main body may be reduced.

The joint and the connection pipe for connecting the main body with the suction nozzle to allow the main body to rotate on two shafts with respect to the suction nozzle in the upward/downward and rightward/leftward direction. Because of that, the steering ability of the main body during the cleaning may be enhanced advantageously.

Especially, the user's burden of the load of the main body may be reduced. Because of that, the user may adjust the movement of the main body easily and smoothly.

It is to be understood that both the foregoing general description and the following detailed description of the embodiments or arrangements are exemplary and explanatory and are intended to provide further explanation of the embodiments as claimed.

BRIEF DESCRIPTION OF THE DRAWINGS

Arrangements and embodiments may be described in detail with reference to the following drawings in which like reference numerals refer to like elements and wherein.

DETAILED DESCRIPTION

Reference may now be made in detail to specific embodiments, examples of which may be illustrated in the accompanying drawings. Wherever possible, same reference numbers may be used throughout the drawings to refer to the same or like parts.

Figure 1:
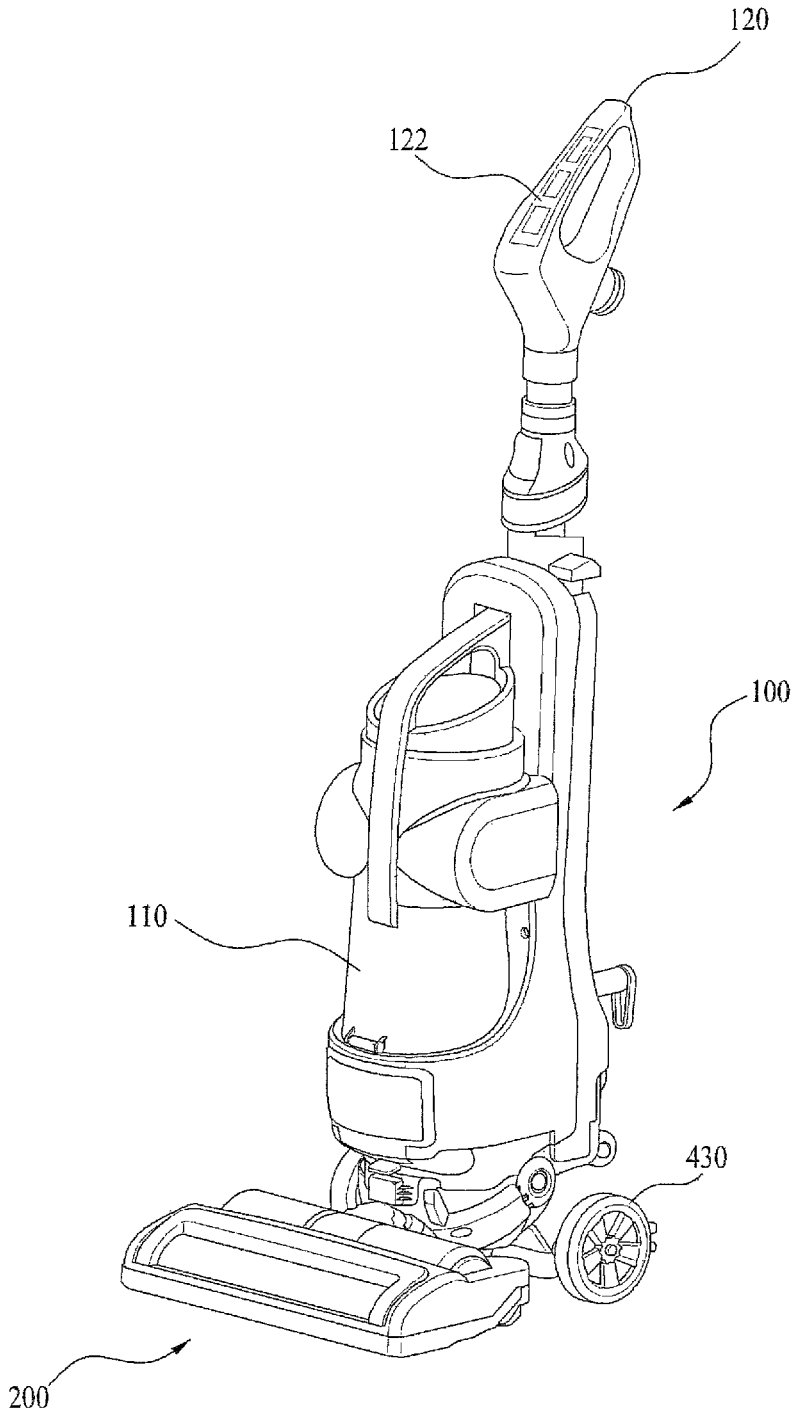
FIG. 1 is a perspective view illustrating a front surface of an upright type vacuum cleaner according to an embodiment.

FIG. 1 is a perspective view illustrating a front surface of an upright type vacuum cleaner according to an embodiment. The configuration and operation of the upright type vacuum cleaner may be described in detail in reference to FIG. 1.

The upright type vacuum cleaner shown in FIG. 1 may include a main body 100, a suction nozzle 200 and a handle 120. A dust collection box 110 may be arranged in the main body 100 and dust and foreign matters scattered on a surface to clean may be collected in the dust collection box 110. The suction nozzle 200 may be provided below the main body 100 and it may suck air together with the dust and foreign matters scattered on the surface to clean. The handle 120 may be provided beyond the main body 100 to allow a user trying to move the main body 100 to grasp.

The main body 100 may be arranged above the suction nozzle 200 and it may be rotatably coupled to the nozzle 200.

Because of that, the main body 100 may be provided with a variable arrangement angle with respect to the surface to be cleaned. The user may perform cleaning in a state of rotating the main body toward the surface to clean.

The dust collection box 110 may be detachably coupled to a front surface of the main body 100 and it may include a dust separation member (not shown) that filters the dust and foreign matters contained in the air sucked into the main body 100 by cyclone theory.

In other words, the air sucked into the main body 100 via the suction nozzle 200 may be drawn into the dust collection box 110. The dust and foreign matters contained in the air drawn into the dust collection box 110 may be filtered by the dust separation member and the filtered dust and foreign matters may be collected in the dust collection box 110.

After that, clean air having the dust and foreign matters separated there from may be exhausted outside the main body 100.

Also, the dust collection box 110 may be detachable coupled to the main body 100. In case that user desires to throw away the dust and foreign matters collected in the dust collection box 110, the user may separate the dust collection box 110 from the main body 100 easily.

In the meanwhile, the dust collection box 110 shown in FIG. 1 may be cylindrical shaped and it may be square-column-shaped or polygonal-column-shaped. The embodiment may not be limited to the shape of the dust collection box 110.

The suction nozzle 200 may be provided below the main body 100 and it may suck the air together with the dust and foreign matters scattered on the surface to clean, while moving along the surface.

In other words, a inlet (not shown) having a slit shape cut-way along a longitudinal direction with respect to the suction nozzle 200 may be formed in a lower surface of the suction nozzle 200.

A suction force generated by the suction motor (not shown) arranged in the main body 100 may be transferred to the inlet, to suck the dust and foreign matters scattered on the surface to clean into the main body 100.

In the meanwhile, a pair of wheels 430 may be rotatably provided in both sides of a lower end of the main body 100.

When the user performs the cleaning, the suction nozzle 200 may be moving in forward/rearward and right/left directions with respect to the cleaned surface to suck the dust and foreign matters located on the cleaned surface and the pair of the wheels 430 may be rotated to enable the suction nozzle 200 to move along the cleaned surface smoothly.

In the meanwhile, the handle 120 may be provided above the main body 100. Because of that, when performing the cleaning, the user may grasp the handle 120, so that the main body 100 may be then supported to keep a predetermined angle rotated state.

An operation panel 122 may be provided on the handle 120. The user may push a button provided on the operation panel 122 to operate an operational condition of the upright type vacuum cleaner according to the embodiment.

For example, the user may control a suction level, a cleaning time of the suction nozzle 200 based on a state of the surface to be cleaned, only to enhance user convenience.

Figure 2:
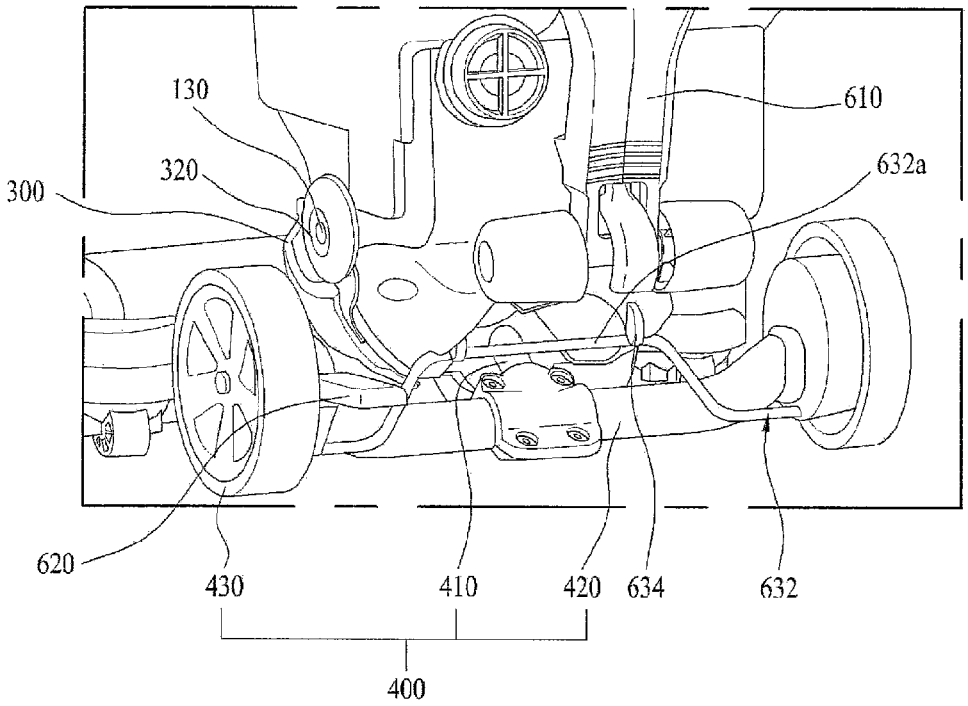
FIG. 2 is a perspective view illustrating a rear surface of the upright type vacuum cleaner according to the embodiment.

FIG. 2 is a perspective view illustrating a rear surface of the upright type vacuum cleaner according to the embodiment. In reference to FIG. 2, the configuration and operation of the upright type vacuum cleaner according to the embodiment will be described in detail.

As mentioned above, description of the same component elements as those of the upright type vacuum cleaner shown in FIG. 1 will be omitted.

A supporting unit 610 may be rotatably provided in a rear surface of the main body 100.

In other words, an upper end of the supporting unit 610 may be rotatably coupled to the rear surface of the main body 100 and a lower end of the supporting unit 610 may be fixed to the rear surface of the main body 100 by a fixing device (not shown) provided in the main body 100, in close contact with that.

When the user does not use the supporting unit 610 during the cleaning or the user keeps it in a storage space, the lower end of the supporting unit 610 may be fixed to the rear surface of the main body 100 by the fixing device in close contact to perform the cleaning efficiently or to utilize the storage space efficiently by reducing a volume of the main body 100.

In the meanwhile, when the user performing the cleaning by rotating the main body 100 toward the surface to clean to vary the arrangement angle of the main body 100 with respect to the surface, the supporting unit 610 may move the main body 100 to a supporting position with respect to the surface to clean.

That is, the user may detach the supporting unit 610 from the fixing device and the supporting unit 610 may be then rotated a predetermined angle, such that the supporting unit may keep the supporting state with respect to the main body 100.

As mentioned above, when the supporting unit 610 may support the main body 100 with respect to the surface to be cleaned, the supporting unit 610 may distribute a load of the main body 100 and the user may perform the cleaning smoothly, without concern of the load applied to the main body 100.

In the meanwhile, a rotation guide member 300 may be provided in a lower part of the main body 100 to guide the rotational movement of the main body 100.

The rotation guide member 300 may be formed in a hemisphere shape partially surrounding a lower part of the main body 100 and it may guide upward/downward and rightward/leftward rotational movement of the main body 100.

In other words, coupling protrusions 130 may be provided in both sides of the main body 100 and the coupling protrusions 130 may be inserted in coupling grooves 320 formed in both sides of the rotation guide member 300. The main body 100 may be rotated on a shaft with the rotation guide member 300 along an upward and downward direction.

In the meanwhile, a supporting assembly 400 which will be described later may be provided in the lower part of the main body 100. The supporting assembly 400 may be connected with the rotation guide member 300 to support the load of the main body 100 and to guide the movement of the main body with respect to the surface to clean simultaneously.

That is, the supporting assembly 400 may include a first supporting shaft 410, a second supporting shaft 420 and wheels 430, which will be described later in detail.

The upright type vacuum cleaner according to the embodiment may be kept in a state of standing upright.

As a result, a fixing frame 632 may be provided in the lower part of the main body 100 and the upright standing of the main body 100 may be kept.

The fixing frame 632 may connect inner side surfaces of the two wheels 430 properly distant from each other. The fixing frame 632 may be rotatably provided in the inner side surfaces of the wheels 430.

A bending part 632*a* may be provided in a center area of the fixing frame 632. The bending part 632*a* of the fixing frame 632 may be inserted in fixing recesses 634 formed in the lower part of the main body 100, to lock the rotational movement of the main body 100.

The user may rotate the fixing frame 632 and he or she may detach the fixing frame 632, especially, the bending part 632*a* from the fixing recesses 634, to unlock the rotational movement of the main body 100. Because of that, the user may perform the cleaning, with changing the arrangement angle of the main body 100 with respect to the surface to be cleaned.

In the meanwhile, a lever 620 may be provided at the fixing frame 632 and the fixing frame 632 may be moved according to the movement of the lever 620.

As a result, only when stepping on the lever simply, the user may rotate the fixing frame 632 to detach the fixing frame 632 from the fixing recesses 634.

Figure 3:
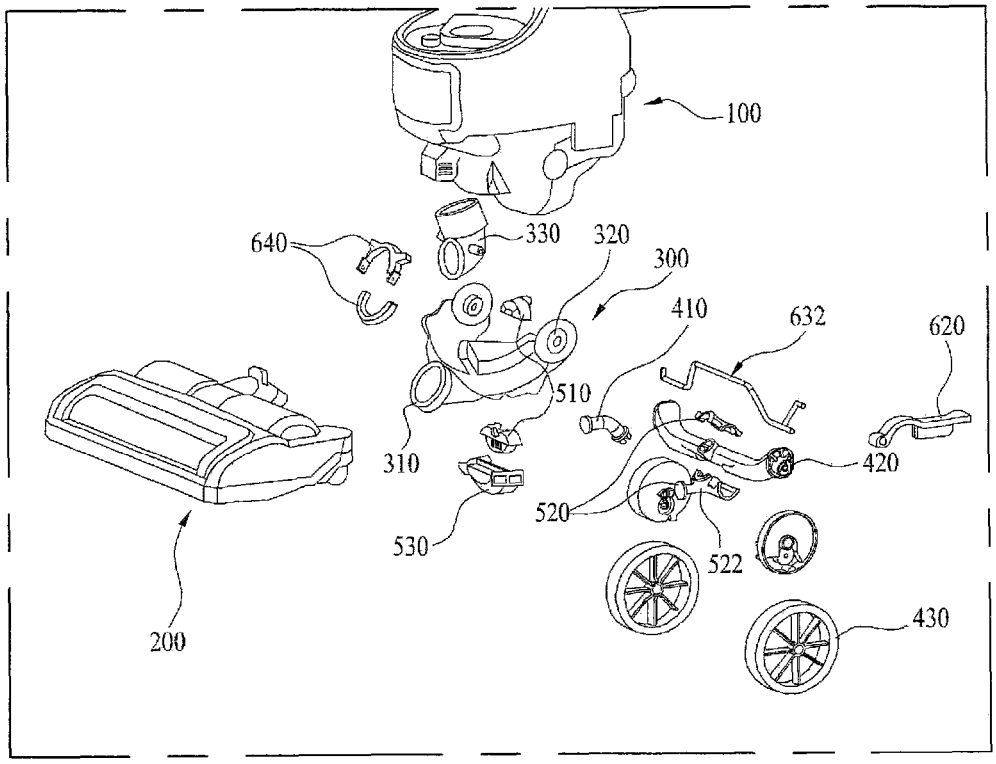
FIG. 3 is an exploded perspective view illustrating a lower part of the upright type vacuum cleaner according to the embodiment.

FIG. 3 is an exploded perspective view illustrating the lower part of the upright type vacuum cleaner according to the embodiment. In reference to FIG. 3, the component parts of the structure supporting the main body 100 of the upright type vacuum cleaner will be described in detail.

The upright type vacuum cleaner may include the main body, the suction nozzle 200 provided below the main body 100 and the rotation guide member 300 provided between the main body 100 and the suction nozzle 200.

As mentioned above, the suction motor (not shown) may be arranged in the main body 100 and the suction nozzle 200 may be in communication with the suction motor. Because of that, the suction force generated in the suction motor may enable the suction nozzle to suck the dust and foreign matters scattered on the surface to be cleaned.

In the meanwhile, the main body 100 and the rotation guide member 300 may be connected with each other by a suction pipe 330 that forms a passage to suck the air sucked via the suction nozzle 200 toward the inside of the main body 100.

The rotation guide member 300 may connect the main body 100 and the suction nozzle 200 with each other, like the suction pipe 330, and it may have the main body 100 seated thereon to guide the rotational movement of the main body 100.

In other words, the rotation guide member 300 may be provided in a hemisphere shape, with surrounding a predetermined area of the lower part of the main body 100. The coupling grooves 320 may be formed in both sides of the rotation guide member 300.

The coupling protrusions 130 provided in both sides of the main body 100 may be inserted in the coupling grooves 320, such that the main body 100 may be connected with the rotation guide member 300.

As a result, the rotation guide member 300 may guide the main body 100 to perform the rotational movement on the coupling shaft with the rotation guide member 300, namely, in the upward and downward direction.

In the meanwhile, the connection pipe 310 extended toward the suction nozzle 200 may be provided in the side of the rotation guide member 300. The suction nozzle 200 may be coupled to the connection pipe 310, such that the suction nozzle 200 may be connected with the rotation guide member 300.

The suction pipe 330 that connects the main body 100 and the suction nozzle 200 with each other may be inserted in the connection pipe 310.

A flange 640 may be provided between the suction nozzle 200 and the connection pipe 310, to make strong the coupling of the suction nozzle 200 and the connection pipe 310.

In addition, the flange 640 may close makes the suction nozzle 200 and the connection pipe 310 closed airtight to prevent leakage of the air drawn into the main body 100 via the suction nozzle 200.

As mentioned above, the supporting assembly 400 may be provided in the lower part of the main body 100. The supporting assembly 400 may include the first supporting shaft 410, the second supporting shaft 420 and the wheels 430, to support the load of the main body 100 and to guide the movement of the main body 100 with respect to the surface to be cleaned.

In other words, the first supporting shaft 410 may be connected with the lower surface of the rotation guide member 300 and the load of the main body 100 may be transferred to the first supporting shaft 410.

Typically, the main body of the conventional upright type vacuum cleaner is seated on a top of the suction nozzle and the suction nozzle may support the load of the main body. However, according to this embodiment, the first supporting shaft 410 may support the load of the main body 100 and the steering ability of the upright type vacuum cleaner may be enhanced accordingly.

The first supporting shaft 410 may be employed as a rightward and leftward rotation shaft of the main body 100. Because of that, the user may rotate the main body 100 about the first supporting shaft 410 in the rightward and leftward direction in main body of performing the cleaning.

The second supporting shaft 420 may be provided at an end of the first supporting shaft 410. The second supporting shaft 420 may be connected with the end of the first supporting shaft 410 to receive the load of the main body 100 transferred to the first supporting shaft 410.

In the meanwhile, the first supporting shaft 410 may be coupled to the rotation guide member 300 by a first connection member 510 and it may be coupled to the second supporting shaft 420 by a second connection member 520.

The second connection member 520 may include a third supporting shaft 522 extended toward the suction nozzle 200 from an end thereof. The third supporting shaft 522 may be coupled to the rotation guide member 300 by a third connection member 530.

As mentioned above, the pair of the wheels 430 may be rotatable provided in both sides of the lower part of the main body 100.

In other words, the wheels 430 may be rotatably coupled to both ends of the second supporting shaft 420. Because of that, the movement ability of the upright type vacuum cleaner according to the embodiment may be enhanced and the load of the main body 100 transferred to the second supporting shaft 420 may be distributed to the surface to clean simultaneously.

The fixing frame 632 may be provided in the lower part of the main body 100 to maintain the upright standing of the main body 100.

In other words, the fixing frame 632 may be inserted in the fixing recesses 634 formed in the lower part of the main body 100 and it may limit the rotational movement of the main body 100.

The fixing frame 632 may be connected to the lever 620 provided adjacent to the fixing frame 632, so that the user may detach the fixing frame 632 from the fixing recesses 634 only if stepping the lever 620.

Figure 4:
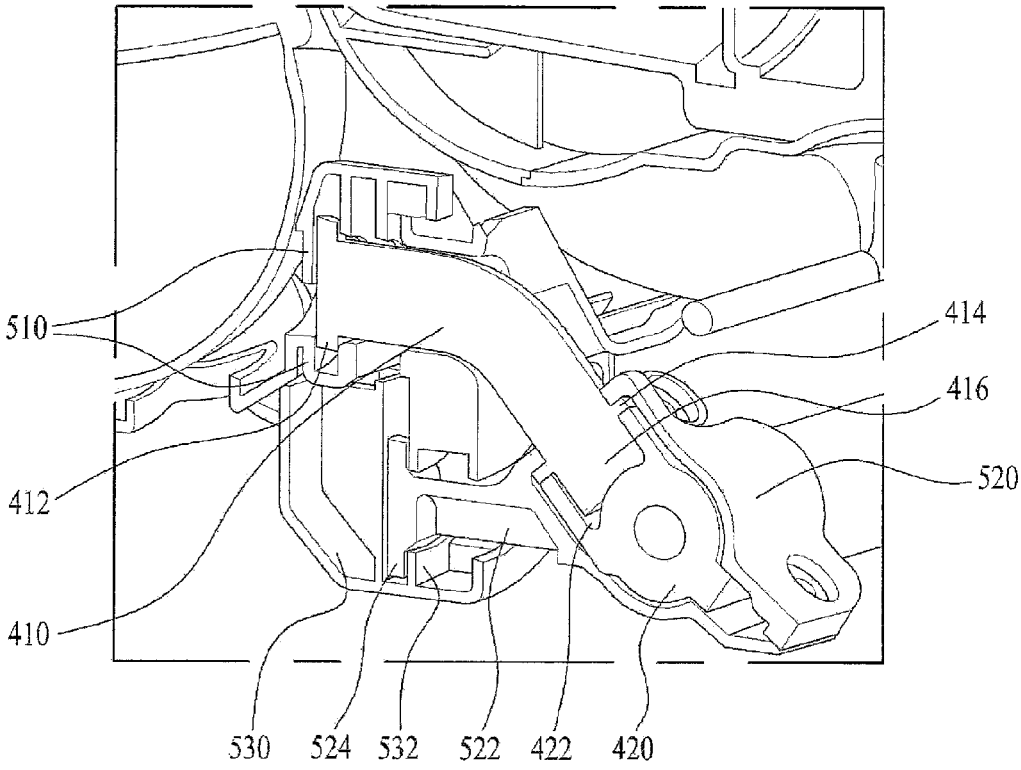
FIG. 4 is a sectional view illustrating a supporting structure of the upright type vacuum cleaner according to the embodiment.

FIG. 4 is a sectional view illustrating the supporting structure of the upright type vacuum cleaner according to the embodiment. In reference to FIG. 4, the structure configured to support the main body 100 of the upright type vacuum cleaner will be described in detail.

First of all, the main body 100 in which the suction motor (not shown) for generating the suction force and the dust collection box (110, see FIG. 1) for collecting dust and foreign matters therein are arranged may have much load itself. The first supporting shaft 410 may be provided in the lower part of the main body 100 to support the load of such the main body 100.

In other words, the rotation guide member 300 may be provided in the lower part of the main body 100 to guide the rotational movement of the main body 100. The first supporting shaft 410 may be coupled to the rotation guide member 300 to support the load of the main body 100.

Here, the first supporting shaft 410 may be coupled to the rotation guide member 300 by the first connection member 510. To make the first supporting shaft 410 coupled to the first connection member 510 more stably, a first rib 412 may be provided at the other end of the firs supporting shaft 410.

The first rib 412 may be stepped on an outer circumference of the other end of the first supporting shaft 410, to be fixedly inserted in the first connection member 510.

In the meanwhile, the second supporting shaft 420 may be connected with an end of the first supporting shaft 410 to distribute the load of the main body 100 transferred to the first supporting shaft 410 to the surface to clean.

In other words, the second supporting shaft 420 may be perpendicular to the first supporting shaft 410 and an end of the first supporting shaft 410 may be connected with a longitudinal center of the second supporting shaft 420 by the second connection member 520. Because of that, the load of the main body 100 supported by the first supporting shaft 410 may be transferred to the second supporting shaft 420.

In the meanwhile, the height of the point at which the other end of the first supporting shaft 410 is coupled to the rotation guide member 300 may be different from the height of the point at which the end of the first supporting shaft 410 is coupled to the second supporting shaft 420. Because of that, the first supporting shaft 410 may be bending downward toward the end from the other end.

That is, the point at which the other end of the first supporting shaft 410 is coupled to the rotation guide member 300 may be formed higher than the point at which the end of the first supporting shaft 410 is coupled to the second supporting shaft 420.

This is because the rotation guide member 300 is formed higher than the second supporting shaft 420.

A second rib 414 may be provided at an end of the first supporting shaft 410 to make the end of the first supporting shaft 410 coupled to the second connection member 520 more stably. The second rib 414 may be stepped on an outer circumference of the end of the first supporting shaft 410, to be fixedly inserted in the second connection member 520.

The end of the first supporting shaft 410 may be connected on a longitudinal center of the second supporting shaft 420. Because of that, an insertion part 416 inserted in an insertion recess 422 formed in the second supporting shaft 420 may be formed in the first supporting shaft 410 to make the first supporting shaft 410 coupled to the second supporting shaft 420 more stably.

In other words, the insertion part 416 may be extended a predetermined length from the end of the first supporting shaft 410. The insertion recess 422 may be formed on a longitudinal center of the second supporting shaft 420, toward the end of the first supporting shaft 410.

Here, the second connection member 520 may include a third supporting shaft 522 and the third supporting shaft 522 may be extended from the second connection member 520 to be coupled to the rotation guide member 300. An end of the third supporting shaft 522 may be coupled to the rotation guide member 300 by a third connection member 530.

In other words, the third supporting shaft 522 may be arranged under the first supporting 410, with being coupled to the rotation guide member 300, and it may support the load of the main body 100 by assisting the first supporting shaft 410.

A third rib 524 may be provided at an end of the third supporting shaft 522 to make the end of the third supporting shaft 522 coupled to the third connection member 530 more stably. The third rib 524 may be stepped on an outer circumference of the end of the third supporting shaft 522, to be fixedly inserted in the third connection member 530.

When the user performs the cleaning, the main body 100 of the upright type vacuum cleaner may be rotated on the third supporting shaft 410 in a right and left direction.

At this time, the third connection member 530 coupling the third supporting shaft 522 with the rotation guide member 300, with positioned under the third supporting shaft 410, may be rotated on the third supporting shaft 522 in a right and left direction, according to the rotation movement of the main body 100.

As a result, a guide rib 532 may be provided in an inner circumferential surface of the third connection member 530 and the guide rib 532 may guide the relative movement of the third rib 524 provided at the end of the third supporting shaft 522. Also, the guide rib 532 may be provided to fixedly insert the third rib 524, to enhance the supporting power with respect to the main body 100.

Figure 5:
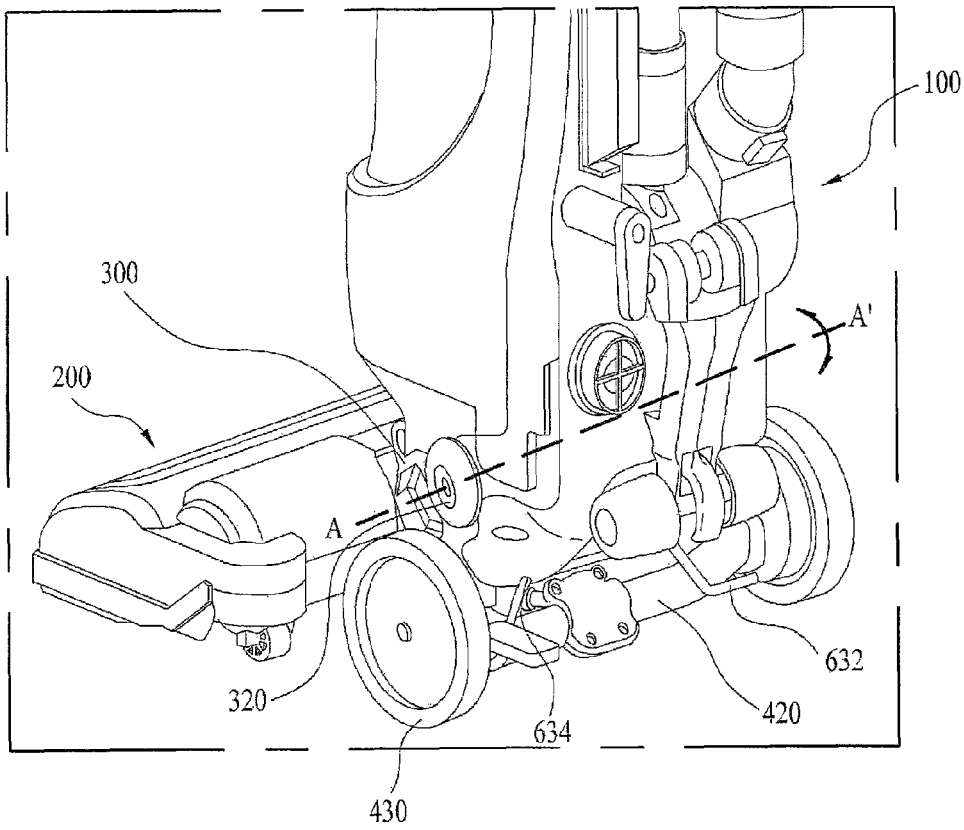
FIG. 5 is a perspective view illustrating a coupling shaft of the upright type vacuum cleaner according to the embodiment.

FIG. 5 is a perspective view illustrating the coupling shaft (A-A') of the upright type vacuum cleaner according to the embodiment. in reference to FIG. 5 will be described the operation process that the main body 100 provided in the upright type vacuum cleaner that is rotated on the coupling shaft upwardly and downwardly.

As mentioned above, the coupling grooves 320 may be formed in both sides of the rotation guide member 300 provided under the main body 100. The coupling protrusions 130 provided in both sides of the main body 100 may be inserted in the coupling grooves 320, respectively, to couple the main body 100 to the rotation guide member 300.

As a result, when user performs the cleaning, the user may detach the fixing frame 632 from the fixing recesses 634 and rotate the main body 100 on the coupling shaft with the rotation guide member 300 upwardly and downwardly. Because of that, the steering ability may be enhanced.

In the meanwhile, the coupling shaft may be formed in parallel to the second supporting shaft 420.

Figure 6:
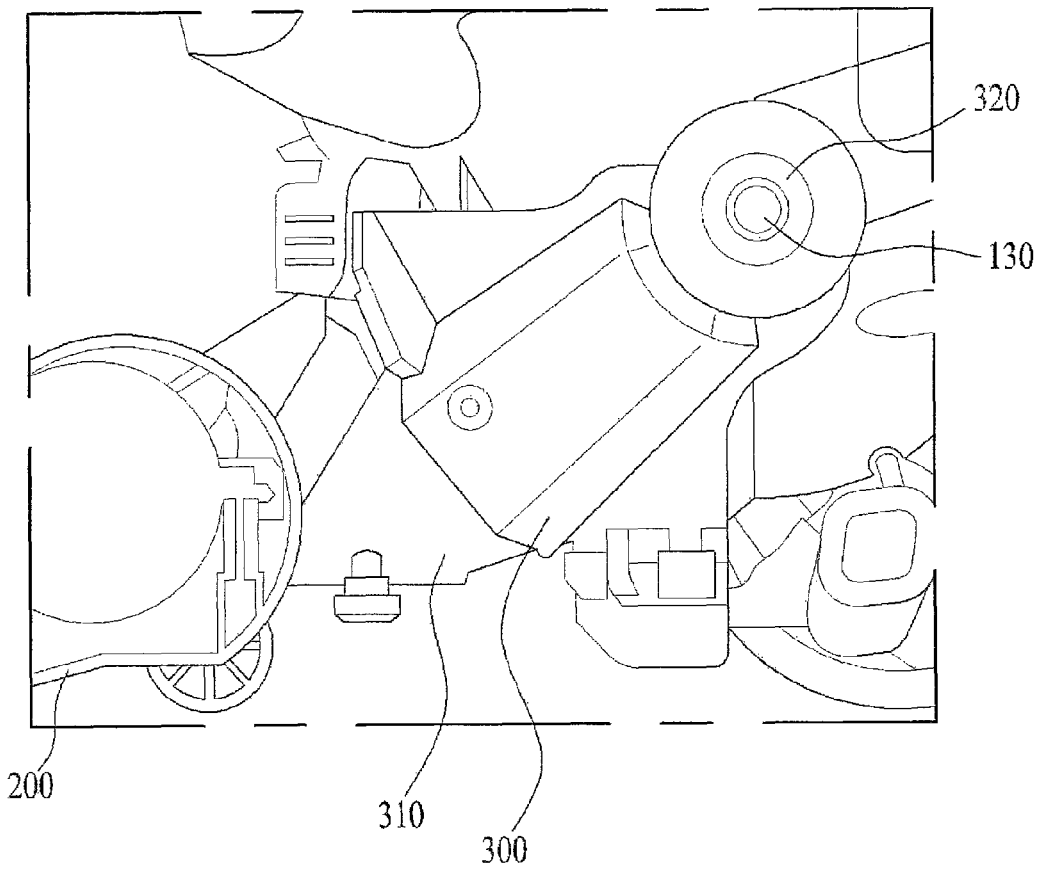
FIG. 6 is a side view illustrating a connecting state between a rotation guide member and a suction nozzle that are provided in the upright type vacuum cleaner according to the embodiment.

FIG. 6 is a side view illustrating the coupling state between the rotation guide member 300 and the suction nozzle 200 that are provided in the upright type vacuum cleaner according to the embodiment. In reference to FIG. 6, the coupling structure between the rotation guide member 300 and the suction nozzle 200 will be described in detail.

As mentioned above, the rotation guide member 300 may formed in a shape that is corresponding to the lower part of the main body 100 to partially surround the lower part of the main body 100 formed in approximately hemisphere shape. The main body 100 may be rotatably coupled to the rotation guide member 300.

Here, the connection pipe 310 may be provided in a front of the rotation guide member 300, to be coupled to the suction nozzle 200. A suction pipe 330 may be provided in the connection pipe 310 as a passage of the air containing dust and foreign matters sucked from the suction nozzle 200 toward the inside of the main body 100.

An end of the connection pipe 310 may be sloped toward the suction nozzle 200. Because of that, when the main body 100 is rotated in the right and left direction, the suction nozzle 200 may be rotated in the right and left direction, in communication with the rotation of the main body 100.

In other words, when the main body 100 is rotated a predetermined angle in the right and left direction, the connection pipe 310 also may be rotated on a shaft thereof according to the rotation of the main body 100. The suction nozzle 200 may be rotated in the right and left direction, according to the rotation of the connection pipe 310. Because of that, the arrangement direction of the suction nozzle 200 may be changed.

As a result, the suction nozzle 200 may be automatically rotated along the direction in which the main body 100 is rotated, only if the user rotates the main body 100 in the right and left direction. Because of that, the steering ability of the upright type vacuum cleaner and the user convenience may be improved.

Figure 7:
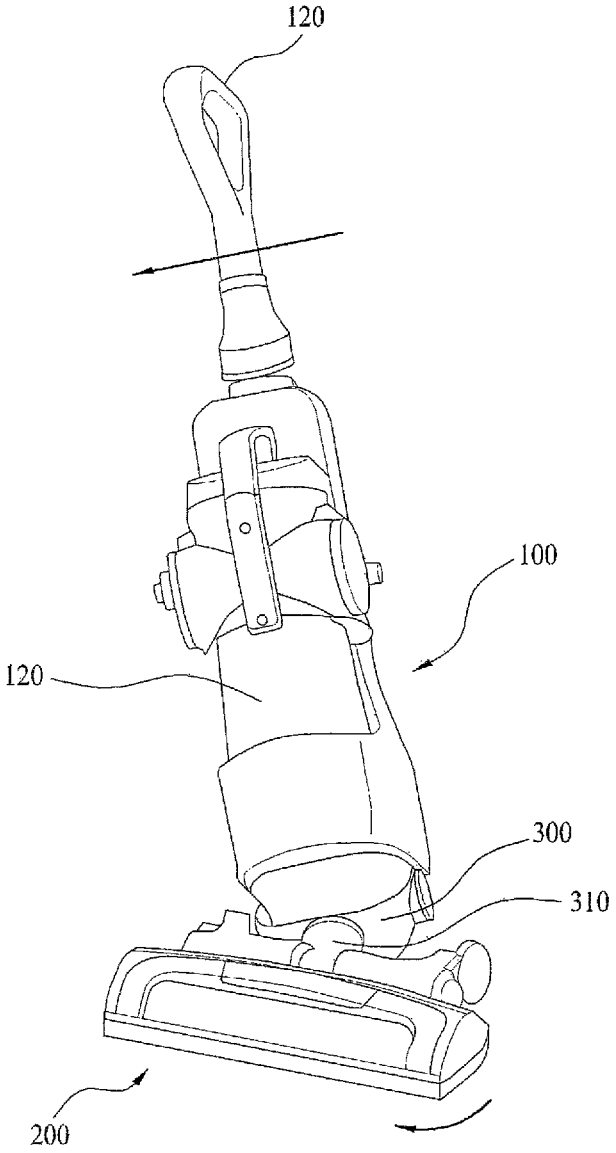
FIGS. 7 and 8 are perspective view illustrating the upright type vacuum cleaner according to the embodiment that is rotated in a right and left direction.
Figure 8:
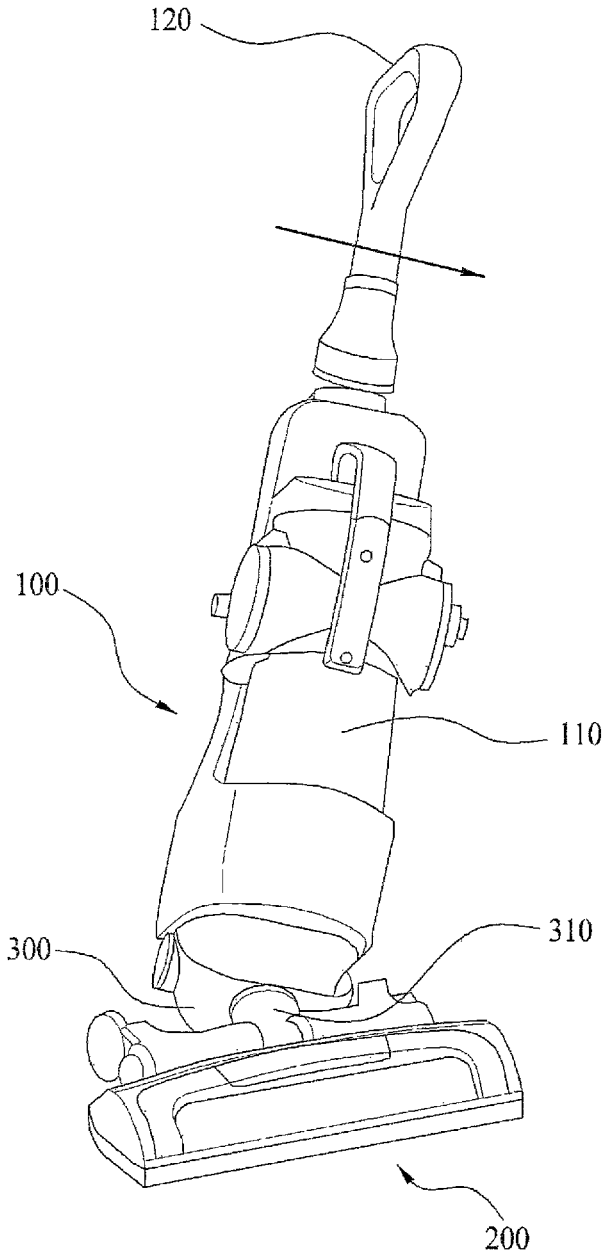

FIGS. 7 and 8 are perspective views illustrating the rightward and leftward rotated state of the upright type vacuum cleaner according to the embodiment.

As shown in FIG. 7, in case that user tries to change the moving direction of the cleaner in a desired direction when performing the cleaning, the user may grasp the handle 120 and rotate the main body 100 in the desired direction.

Hence, as the main body 100 rotated in the direction, the rotation guide member 300 also may be rotated in the direction. As mentioned above, the suction nozzle 200 also may be rotated in the moving direction of the main body 100 by the interaction between the suction nozzle 200 and the slope formed in the end of the connection pipe 310.

As shown in FIG. 8, in main body of trying to change the moving direction of the vacuum cleaner toward another direction during the cleaning, the user may grasp the handle 120 and user may rotate the main body 100 in another direction.

Hence, the rotation guide member 300 and the connection pipe 310 also may be rotated in a predetermined direction when the main body 100 rotated in the direction. The suction nozzle 200 also may be rotated along the moving direction of the main body 100 by the interaction between the suction nozzle 200 and the slope formed in the end of the connection pipe 310.

As a result, the suction nozzle 200 may be automatically rotated in the rotation direction of the main body 100, only when the user rotates the main body 100 in the right and left direction as mentioned above. Because of that, the user may perform the cleaning, with changing the moving direction of the vacuum cleaner smoothly and easily.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to affect such feature, structure, or characteristic in connection with other ones of the embodiments. Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

According to the embodiment, the supporting assembly including the plurality of the supporting shafts arranged perpendicular to each other. Because of that, the load of the main body may be distributed and the supporting power with respect to the main body may be increased. Also, the user's physical fatigue caused by the load of the main body may be reduced.

The joint and the connection pipe for connecting the main body with the suction nozzle to allow the main body to rotate on two shafts with respect to the suction nozzle in the upward/downward and rightward/leftward direction. Because of that, the steering ability of the main body during the cleaning may be enhanced advantageously.

Especially, the user's burden of the load of the main body may be reduced. Because of that, the user may adjust the movement of the main body easily and smoothly.

What is claimed is:

1. An upright type vacuum cleaner comprising:

a main body;

a suction nozzle provided below the main body;

a rotation guide member provided between the main body and the suction nozzle, to guide rotational movement of the main body to change an arrangement angle of the main body with respect to a surface which will be cleaned; and a supporting assembly connected with the rotation guide member, to support load of the main body and to guide the movement of the main body with respect to the surface to be cleaned, wherein the supporting assembly comprises, a first supporting shaft connected with the rotation guide member, to receive the load of the main body;

a second supporting shaft connected with an end of the first supporting shaft to transfer the load of the main body to the first supporting shaft; and wheels rotatably provided at both ends of the second supporting shaft to distribute the load of the main body transferred to the second supporting shaft to the surface which will be cleaned.

2. The upright type vacuum cleaner of claim 1, wherein the first supporting shaft and the second supporting shaft are arranged perpendicular to each other.

3. The upright type vacuum cleaner of claim 1, wherein the first supporting is bending downwardly toward the end thereof from the other end thereof.

4. The upright type vacuum cleaner of claim 1, further comprising:

a first connection member to connect the other end of the first supporting shaft with the rotation guide member, wherein a first rib stepped to be fixedly inserted in the first connection member is provided at an outer circumference of the other end of the first supporting shaft.

5. The upright type vacuum cleaner of claim 1, further comprising:

a second connection member to connect the end of the first supporting shaft with the second supporting shaft, wherein a second rib stepped to be fixedly inserted in the second connection member is provided at an outer circumference of the end of the first supporting shaft.

6. The upright type vacuum cleaner of claim 5, wherein an insertion part is extended from the end of the first supporting shaft and an insertion recess is formed in the second supporting shaft toward the end of the first supporting shaft to insert the insertion part therein.

7. The upright type vacuum cleaner of claim 5, wherein the second connection member comprises a third supporting shaft extended there from to be connected with the rotation guide member.

8. The upright type vacuum cleaner of claim 7, further comprising:

a third connection member to connect an end of the third supporting shaft with the rotation guide member, wherein a third rib stepped to be fixedly inserted in the third connection member is provided at an outer circumference of the end of the third supporting shaft.

9. The upright type vacuum cleaner of claim 1, wherein the main body is rotated on the first supporting shaft in a right and left direction.

10. The upright type vacuum cleaner of claim 1, wherein the main body is rotated on a coupling shaft with the rotation guide member in an up and down direction and the coupling shaft is formed in parallel to the second supporting shaft.

11. The upright type vacuum cleaner of claim 10, wherein the third connection member comprises, a guide rib to guide relative movement of the third rib with respect to the third connection member, when the main body is rotated in a right and left direction.

12. The upright type vacuum cleaner of claim 1, wherein the rotation guide member comprises a connection pipe extended there from to be connected to the suction nozzle, and an end of the connection pipe is slope downwardly toward the suction nozzle.

13. The upright type vacuum cleaner of claim 12, wherein the suction nozzle is rotated in a right and left direction according to the rotation of the connection pipe, when the connection pipe is rotated about a shaft according to the right and left direction rotation of the main body, to change an arrangement direction of the suction nozzle.

14. The upright type vacuum cleaner of claim 1, further comprising:

a fixing frame rotatably arranged in inner circumferential surfaces of the wheels, to connect the inner circumferential surfaces of the wheels with each other;

a fixing recess provided in a lower part of the main body to selectively fix the fixing frame based on the rotational movement of the fixing frame to lock or unlock the rotational movement of the main body; and a lever provided at the fixing frame to generate the rotational movement of the fixing frame.

15. The upright type vacuum cleaner of claim 14, further comprising:

a bending part formed in a center of the fixing frame, wherein the bending part is selectively fixed to the fixing recess based on rotational movement of the fixing frame.

16. An upright type vacuum cleaner comprising:

a main body;

a suction nozzle provide below the main body;

a rotation guide member provided between the main body and the suction nozzle, to guide rotational movement of the main body to change an arrangement angle of the main body with respect to a surface which will be cleaned;

a supporting assembly connected with the rotation guide member, to support load of the main body and to guide the movement of the main body with respect to the surface which will be cleaned, wherein the supporting assembly comprises, a first supporting shaft connected with the rotation guide member to receive the load of the main body and to guide right and left direction rotational movement of the main body;

a second supporting shaft connected with an end of the first supporting shaft to transfer the load of the main body to the first supporting shaft and to guide up and down direction rotational movement of the main body; and wheels rotatably provided in both ends of the second supporting shaft to distribute the load of the main body transferred to the second supporting shaft to the surface which will be cleaned.

17. The upright type vacuum cleaner of claim 16, wherein an end of the first supporting shaft is rotatably connected with a center of the second supporting shaft and the other end of the first supporting shaft is rotatably connected with a rear side of the rotation guide member, the upright type vacuum cleaner further comprising:

a first connection member to connect the other end of the first supporting shaft with the rotation guide member; and a second connection member to connect the end of the first supporting shaft with a center of the rotation guide member.

18. The upright type vacuum cleaner of claim 17, further comprising:

a third supporting shaft extended forwardly from the second connection member to be rotatably connected with the rotation guide member; and a third connection member to rotatably connect the third supporting shaft with the rotation guide member.

19. The upright type vacuum cleaner of claim 18, wherein a point at which the other end of the first supporting shaft is connected with the rotation guide member is higher than a point at which the end of the first supporting shaft is connected with the second supporting shaft, and the first supporting shaft is bending downwardly toward the end thereof toward the other end thereof.

20. The upright type vacuum cleaner of claim 16, further comprising:

a fixing frame rotatably arranged in inner circumferential surfaces of the wheels, to connect the inner circumferential surfaces of the wheels with each other;

a fixing recess provided in a lower part of the main body to selectively fix the fixing frame based on the rotational movement of the fixing frame to lock or unlock the rotational movement of the main body; and a lever provided at the fixing frame to generate the rotational movement of the fixing frame, wherein a bending part is formed in a center of the fixing frame and the bending part is selectively fixed to the fixing recess based on rotational movement of the fixing frame.

* * * * *